US006349933B1

(12) United States Patent
Scheffer et al.

(10) Patent No.: US 6,349,933 B1
(45) Date of Patent: Feb. 26, 2002

(54) METHOD AND APPARATUS FOR HORIZONTAL STACKING AND BATCHING OF SHEET PRODUCTS

(75) Inventors: Bruce A. Scheffer, Valparaiso; Eric K. Lo, Hobart, both of IN (US)

(73) Assignee: Scheffer, Inc., Merrillville, IN (US)

( * ) Notice: Subject to any disclaimer, the term of this patent is extended or adjusted under 35 U.S.C. 154(b) by 0 days.

(21) Appl. No.: 09/416,238

(22) Filed: Oct. 12, 1999

(51) Int. Cl.[7] ..... B65H 29/38

(52) U.S. Cl. ..... 271/177; 271/185; 271/198; 271/207; 271/213

(58) Field of Search ..... 271/185, 184, 271/177, 198, 207, 213, 214, 220; 198/407, 412, 405

(56) References Cited

U.S. PATENT DOCUMENTS

| | | | | |
|---|---|---|---|---|
| 2,841,394 A | * | 7/1958 | Stobb | 271/185 |
| 3,236,162 A | | 2/1966 | Reist | |
| 3,529,168 A | | 9/1970 | Guggisberg | |
| 3,638,695 A | | 2/1972 | Grotewald et al. | |
| 3,826,348 A | | 7/1974 | Preisig et al. | |
| 4,330,116 A | | 5/1982 | Newsome | |
| 4,332,057 A | | 6/1982 | Smith | |
| 4,463,940 A | | 8/1984 | Mock | |
| 4,723,883 A | | 2/1988 | Smith | |
| 4,874,958 A | | 10/1989 | Sampath et al. | |
| 4,941,650 A | | 7/1990 | Raybuck | |
| 5,112,041 A | | 5/1992 | Honegger | |
| 5,368,287 A | | 11/1994 | Belec et al. | |
| 5,399,222 A | | 3/1995 | Reist | |
| 5,409,207 A | | 4/1995 | Freeman | |
| 5,411,250 A | | 5/1995 | Belec et al. | |
| 5,433,430 A | | 7/1995 | Straessler et al. | |
| 5,462,268 A | | 10/1995 | Remy et al. | |

* cited by examiner

*Primary Examiner*—David H. Bollinger
(74) *Attorney, Agent, or Firm*—Welsh & Katz, Ltd.

(57) ABSTRACT

A method and apparatus for horizontal stacking of sheets or signatures received from a web press or the like includes conveyor sections operative to convey the sheets in shingled relation from a generally horizontal conveyor path to an inclined conveyor section that progressively rotates the sheets to inclined positions such that the sheets slide downward against an edge guide. The inclined sheets then pass upwardly through a loop conveyor section at an inclined angle to vertical. The upper edge of each success sheet engages a stop mechanism after which the sheets move horizontally into a generally V-shaped trough that engages and supports two downwardly facing edges of each sheet. The stop mechanism is operative to cause the upper edge of one or more sheets immediately following a predetermined number of sheets that constitute a desired batch to extend higher than the preceding sheets so as to define a physical readily visible demarcation between sheet bundles, thereby enabling an operator to quickly and precisely remove successive sheet bundles. Various mechanisms associated with the trough facilitate placement of batches of sheets in a box container or in position for transfer to a pallet or banding apparatus.

20 Claims, 9 Drawing Sheets

METHOD AND APPARATUS FOR HORIZONTAL STACKING AND BATCHING OF SHEET PRODUCTS

BACKGROUND OF INVENTION

The present invention relates generally to apparatus for horizontal stacking of sheets or signatures received from a web press, and more particularly to a novel method and apparatus for horizontal stacking of sheets in a manner providing improved support of the stacked sheets and enabling precise batches of sheets to be readily removed by an operator from the horizontal stack.

It is a common practice in the art of web press printing to convey successive sheets or signatures downstream from the web press in a generally flat partially overlapped or shingled orientation. The successive sheets are initially conveyed along a generally horizontal path during which they may pass between crusher rolls for removing air from between the overlapped sheets, followed by passage through a jogger station operative to jog the sheets into precise overlying relation. The successive conveyed sheets are then stacked in either a generally vertical stack from which bundles or batches of sheets are removed, or in a horizontal stack preparatory to removing batches of sheets.

Vertical stack forming systems exhibit significant drawbacks in that the stack height is limited and the weight of the stack can cause sheet backups if not promptly removed. The known vertical sheet stacking systems also mark the stack at a particular height to define each successive bundle of sheets. This marking technique makes it difficult for an operator to accurately separate and readily remove bundles of predetermined sheets from the stack.

In another prior vertical sheet stacking system, successive sheets or signatures are conveyed flat along a horizontal path and deposited onto a vertical stack supported on a downstream conveyor until a stack of a predetermined number of sheets is formed. The upstream conveyor must then be interrupted while the downstream conveyor is moved or indexed to present a new stack position for receiving sheets from the upstream conveyor. This system significantly reduces the speed at which vertical of stacks sheets may be formed.

In prior horizontal sheet stacking systems, successive sheets or signatures from the web press pass from a generally horizontal conveyor path through a loop conveyor section operative to convey the sheets in an upward generally vertical direction so that the leading edge of each successive sheet engages a stop after which the sheets undergo horizontal movement into a horizontal stack while remaining generally vertically disposed.

A significant drawback in the known horizontal sheet stackers is that they fail to provide a suitable demarcation between each predetermined number of vertically oriented sheets that constitute a desired batch and the sheets immediately following that will comprise the next successive batch of sheets. As a result, it is difficult for an operator to rapidly and accurately remove each successive batch of sheets from the horizontal stack.

Other known horizontal sheet stackers attempt to identify each successive batch of vertically disposed sheets by placing a visual marking on the upper edge of either the last sheet in each batch or the first sheet in the next successive batch. However, the marker generally marks the upper edges of a plurality of adjacent sheets so that an accurate identification of the exact trailing end sheet of each batch of sheets cannot be made. Moreover, the marking is frequently difficult to see, thus further inhibiting removal from the horizontal stack of a precise number or batch of sheets.

Still another drawback in the known horizontal sheet stackers is that when successive sheets conveyed upwardly by the loop conveyor engage a stop and are moved horizontally to form a horizontal stack, the sheets are only supported at their lower transverse edges and at their forward and rearward planar surfaces. The vertically disposed sheets may therefore move laterally in the planes of the sheets. Such movement causes the vertical sheet edges that were previously aligned by the jogger to become misaligned, thereby preventing the formation of coplanar side edge surfaces on each batch of sheets. There thus exists a need for a horizontal sheet stacker and batcher that overcomes the drawbacks in prior horizontal sheet stackers and enables precise and rapid removal of batches of sheets while operating at high production rates.

SUMMARY OF THE INVENTION

A general object of the present invention is to provide a method and apparatus for horizontal stacking and batching of sheets or signatures received from a web press wherein significantly improved efficiency and accuracy is achieved at relatively high operating speeds.

A more particular object of the present invention is to provide a method and apparatus for horizontal stacking and batching of generally rectangular sheets or signatures received in shingled relation from a web press wherein successive sheets are conveyed upwardly from a generally horizontal path to a stop mechanism operative to create a physical demarcation between each successive predetermined batch of horizontally stacked sheets, thereby enabling an operator to quickly and accurately remove a predetermined batch of sheets from the horizontal stack.

Another object of the present invention is to provide a horizontal sheet stacking and batching system operative to convey successive shingled generally rectangular sheets or signatures from a web press to a batch forming trough in which the vertically disposed sheets are supported at two downwardly facing edges and at their forward and rearward generally planar surfaces so that aligned lateral edges of the sheets remain coplanar as the sheets move along the trough and when a batch of sheets is removed from the trough.

Another object of the present invention is to provide a method and apparatus for conveying generally rectangular sheets or signatures in shingled relation downstream from a web press wherein successive sheets are rotated about their paths of travel from generally flat horizontal positions to positions inclined to horizontal as they travel along a progressively inclined conveyor section after which the sheets are conveyed in an upward direction along a path normal to the leading edges of the sheets as they leave the downstream end of the inclined conveyor section, thereby orienting the sheets to establish two downwardly facing edges for supporting the sheets as they enter a generally V-shaped trough to form a horizontal stack.

Another object of the present invention is to provide accessories cooperative with the sheet receiving trough of the sheet stacker/batcher that facilitate placement of batches of sheets into a container box or the like, or in position for transfer onto a pallet or to a banding apparatus.

A feature of the present invention lies in the provision of an oscillator roller operatively associated with the conveyor belts forming the upper reach of the conveyor section that inclines the sheets from a horizontal orientation to an inclined orientation as the sheets are conveyed from an upstream end to a downstream end of the inclined conveyor section. The oscillator roller causes the conveyor belts to undergo oscillating or vibrating movement and thereby assist in lateral downward movement of the sheets against an edge guide as they travel along the inclined conveyor path, thus eliminating the need for a jogging mechanism.

Another feature of the present invention lies in positioning an upstream conveyor section so as to be angularly inclined in a generally horizontal plane relative to the direction of sheet travel from the web press so that successive rectangular shingled sheets or signatures passing to the downstream conveyor section have at least one corner individually exposed to facilitate optical counting of the sheets being conveyed downstream.

Still another feature of the present invention lies in providing an edge guide that extends substantially the length of the inclined conveyor section and defines a stop engaged by the lower longitudinal edges of the inclined sheets traversing the inclined conveyor path, the edge guide eliminating the need for a jogger mechanism and being configured to prevent the sheets from inadvertent release from the corresponding conveyor belts.

Another feature of the horizontal sheet stacking and batching apparatus in accordance with the invention lies in providing conveyor belts along each of two upwardly facing surfaces of the V-shaped trough to engage downwardly facing edges of the vertically oriented sheets entering the trough and assist in movement of the sheets along the trough. Backstop plates moveable along the length of the trough enable an operator to isolate successive batches of sheets for removal from the trough.

Further objects, features and advantages of the present invention will become apparent from the following detailed description of the invention taken in conjunction with the accompanying drawings wherein like reference numerals designate like elements throughout the several views.

DETAILED DESCRIPTION

Figure 1:
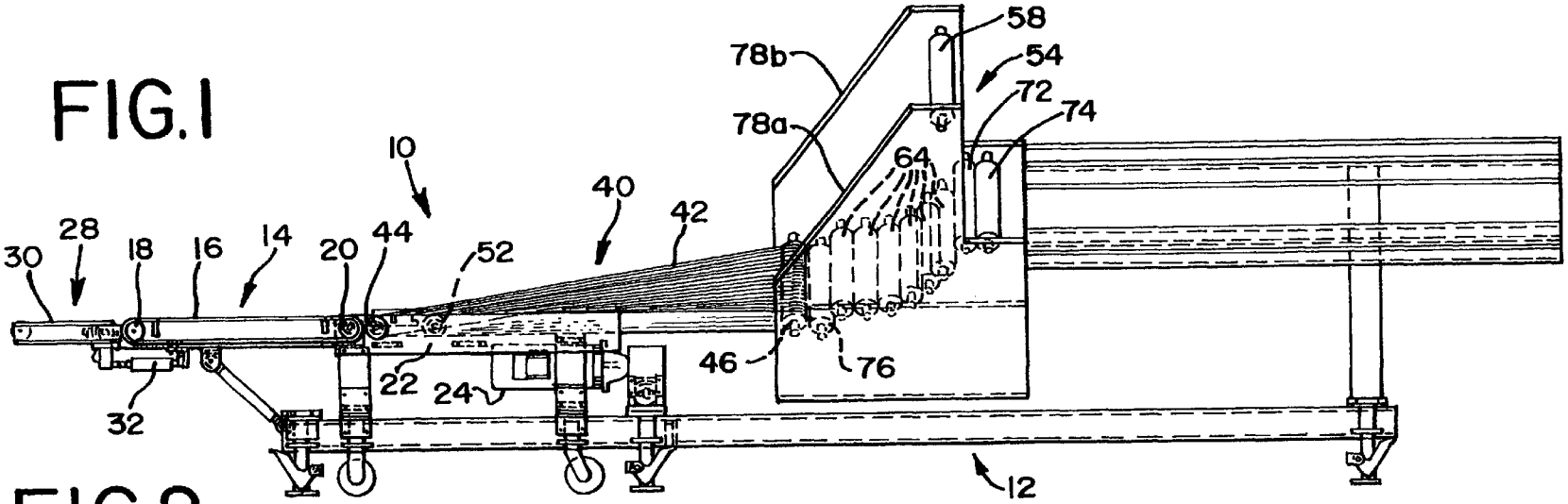
FIG. 1 is an elevational view of a conveyor apparatus constructed in accordance with the present invention for horizontal stacking of sheets or signatures received from a web press or the like, various components being removed for clarity.
Figure 2:
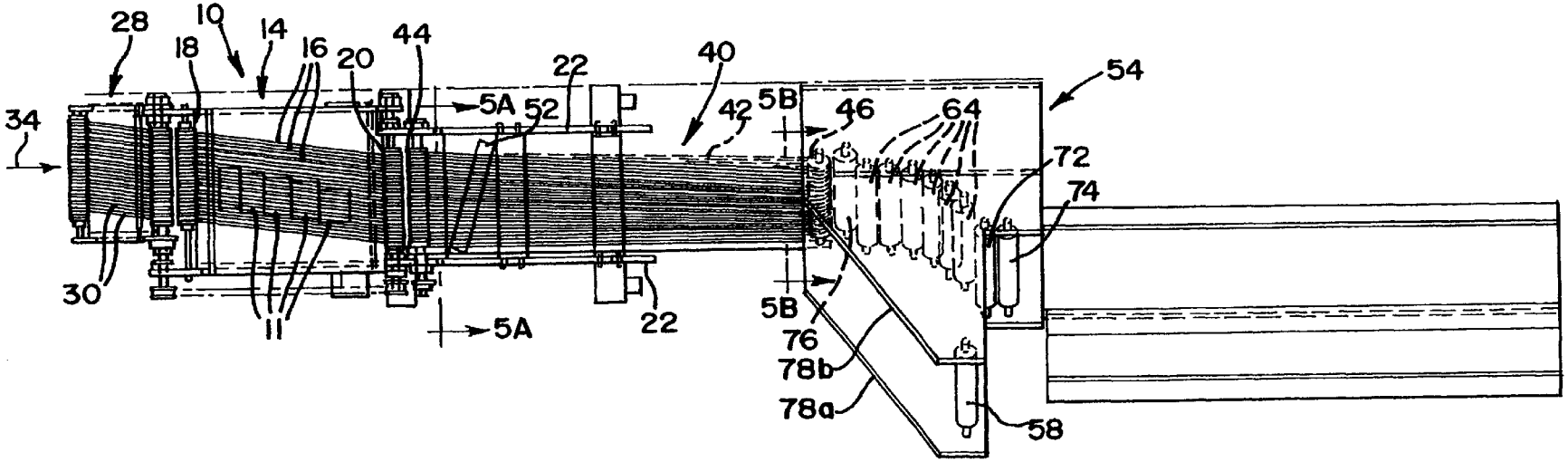
FIG. 2 is a plan view of the conveyor apparatus illustrated in FIG. 1 with the same components removed.

Referring now to the drawings, and in particular to FIGS. 1 and 2, a conveyor apparatus, alternatively termed a conveyor system, for conveying sheets or signatures from a web press or the like into a horizontal stack in accordance with the present invention is indicated generally at 10. As will be described, the conveyor apparatus or system 10 is operative to convey sheets or signatures, particularly generally rectangular shaped sheets as indicated at 11, in shingled relation from a web press and associated cutter station (not shown) upstream from the conveyor apparatus and stack the sheets in a horizontal stack from which batches of sheets of predetermined number can be readily identified by the operator and rapidly and accurately removed from the stack for packaging or conveyance to another operating station.

The conveyor apparatus 10 includes a base frame, indicated generally at 12. The base frame 12 supports a first generally horizontal conveyor section 14 having a plurality of endless conveyor belts 16, preferably of circular cross-section, supported in annular grooves in upstream and downstream rolls 18 and 20 so that the conveyor section 14 defines a horizontal conveyor path that is angularly inclined to the longitudinal axis of the base frame 12. The roll 20 is rotatably supported at an upstream end of a pair of horizontal frame members 22 and is interconnected to a suitable drive mechanism 24, as through a chain drive, to effect movement of the conveyor belts 16. Preferably a shorter length conveyor section 28 is supported by the base frame 12 at the upstream end of conveyor section 14 and has conveyor belts 30 operative to receive sheets or signatures 11 from the web press and convey them along a path aligned with the path defined by the conveyor section 14. The conveyor section 28 is pivotally supported by the base frame and is selectively positionable through an operating cylinder 32 between a substantially horizontal position, as illustrated in FIG. 1, to an upwardly inclined position allowing sheets or signatures initially produced by the web press to drop into a receptacle without being conveyed along the conveyor system 10.

It will be appreciated that when generally rectangular sheets or signatures 11 are received from the web press traveling in a direction represented by arrow 34 in FIG. 2 and are deposited onto the conveyor section 28 in successive shingled fashion, each successive sheet will be laterally offset from the prior sheet as the sheets travel along the conveyor path defined by conveyor sections 28 and 14. In this manner, a leading corner of each sheet 11 and an opposite trailing corner will be individually exposed; that is, each sheet will have a forward corner portion that does not overlie the underlying preceding sheet and will have a rear corner that is not directly underlying the next successive sheet. The exposed corners of the sheets thus enable accurate optical counting of the sheets passing along the conveyor apparatus 10 from the web press.

The shingled sheets pass from the conveyor section 14 onto an inclined conveyor section 40 that is supported by the base frame 12 and includes a plurality of parallel conveyor belts 42 supported by and between an upstream roll 44 and a downstream roll 46. The conveyor belts 42 are of circular cross-section and are received within suitable circumferential grooves in the rolls 44 and 46 so as to maintain the conveyor belts 42 in parallel relation. The roll 46 is suitably interconnected to the drive mechanism 24 as through a drive chain. The roll 44 is supported on the base frame 12 in parallel coplanar relation with the roll 20 of the conveyor section 14 and is suitably interconnected to roll 20 so that the conveyor belts of the conveyor sections 14, 28 and 40 have substantially the same surface speed.

Figure 5B:
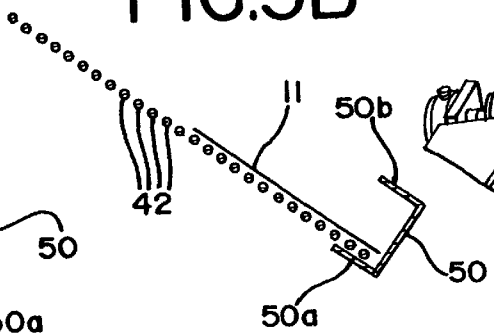
FIGS. 5A and 5B are fragmentary transverse section views taken substantially along lines 5A—5A and 5B—5B of FIG. 2 and diagrammatically illustrating the relationship of the edge guides to the upper conveyor belt reach of the inclined conveyor section.
Figure 5A:
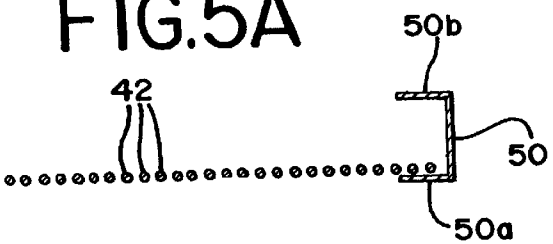

The downstream roll 46 of the conveyor section 40 is inclined at an angle relative to horizontal of between approximately 15 and 70°, and preferably approximately 45°, so that the sheets 11 received from the conveyor section 14 undergo rotation about their direction of travel along the conveyor section 40 from generally flat horizontal positions at the upstream end of the inclined conveyor section to inclined positions relative to horizontal equal to the angle of inclination of the roll 46. As the sheets 11 undergo rotational movement about their direction of travel as they traverse the conveyor section 40, the successive sheets slide downwardly toward the lowermost belt of the upper reach of conveyor belts 42 by gravity so that the lower lateral longitudinal edge of each sheet engages an elongated rectilinear edge guide 50 and orients the successive sheets in shingled edge aligned relation. As shown in FIG. 2, the edge guide 50 extends generally from the upstream roll 44 of conveyor section 40 to a position slightly downstream from the end roll 46. The edge guide is of generally U-shaped cross-sectional configuration and is twisted about its longitudinal axis along its length so that the lowermost conveyor belts in the upper reach of conveyor belts 42 are generally adjacent a lower flange 50*a* of the edge guide as illustrated in FIGS. 5A and 5B. An upper flange 50*b* of the edge guide overlies the moving sheets as they move downwardly against the edge guide and prevents the sheets from being inadvertently displaced from the conveyor section 40.

To assist in movement of the sheets 11 downwardly to engage the edge guide 50 as they are conveyed along the inclined conveyor section 40, a generally cylindrical oscillator roller 52 is rotatably mounted below the upper reach conveyor belts 42 spaced a short distance from their upstream ends. The oscillator roller 52 is adapted to be power rotated and has a plurality of outwardly projecting generally semi-spherical shaped nubs 52*a* formed about its periphery so that the nubs lie on a generally spiral path about the oscillator roller. The nubs 52*a* are positioned so that for each revolution of the oscillator roll about its longitudinal axis, each of the conveyor belts 42 is engaged by a nub to cause the conveyor belts to undergo oscillation or vibratory movement generally normal to their longitudinal axes. This action assists in movement of the sheets 11 downwardly against the edge guide 50 as they traverse the length of the upper reach of the inclined roller section.

Figure 4:
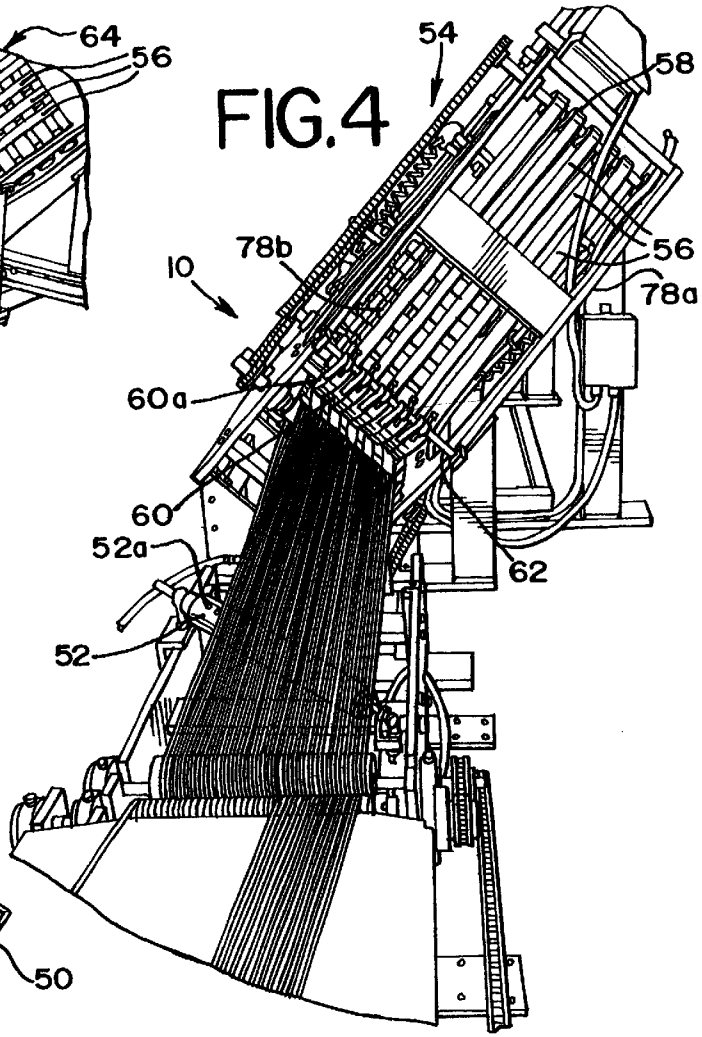
FIG. 4 is a fragmentary elevational view taken from the upstream end of the inclined conveyor section.
Figure 3:
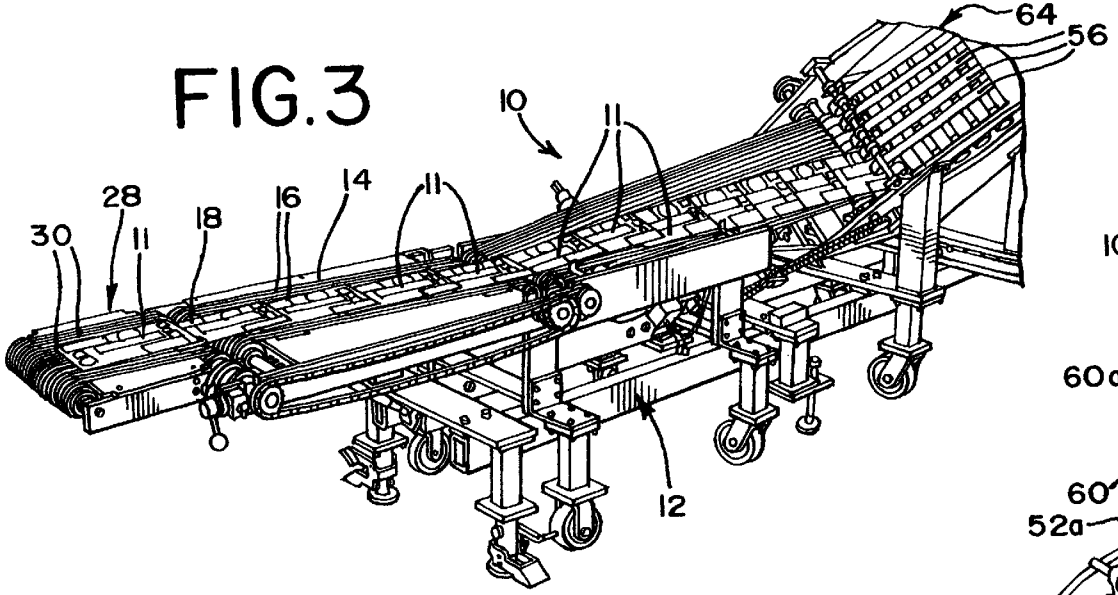
FIG. 3 is a perspective view showing sheets or signatures being conveyed along a first horizontal conveyor path to a conveyor section operative to incline the sheets relative to horizontal, the sheets being conveyed so as to expose at least one corner of each sheet to facilitate optical counting.
Figure 6:
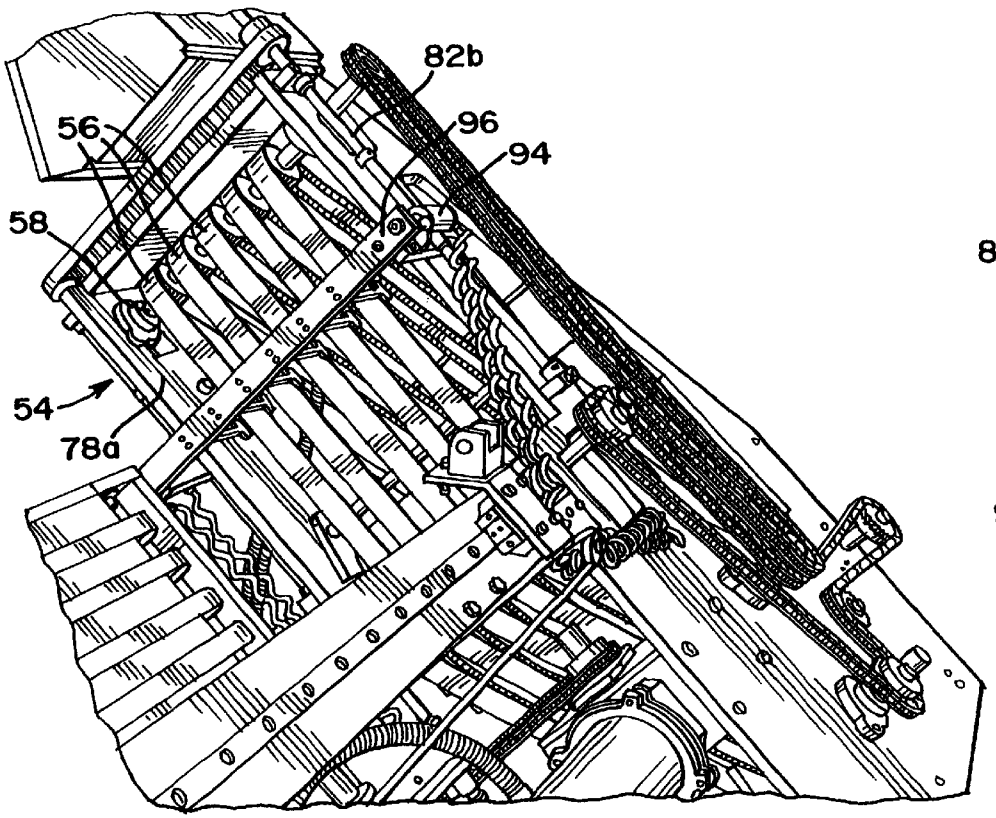
FIG. 6 is a fragmentary perspective view illustrating the downstream end of the loop conveyor section operative to transfer sheets from a horizontal conveyor path to an upwardly directed path.
Figure 8:
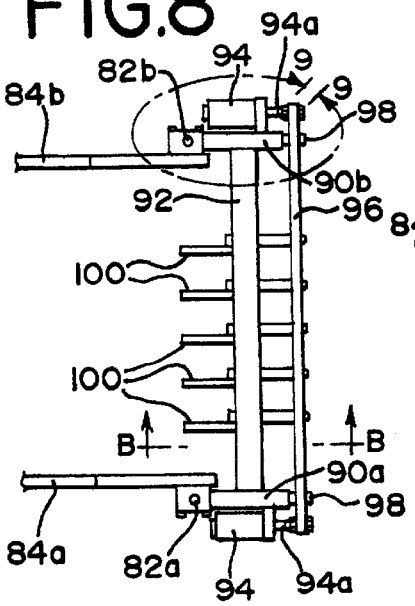
FIG. 8 is a fragmentary plan view of the stop mechanism illustrated in FIG. 7.
Figure 9:
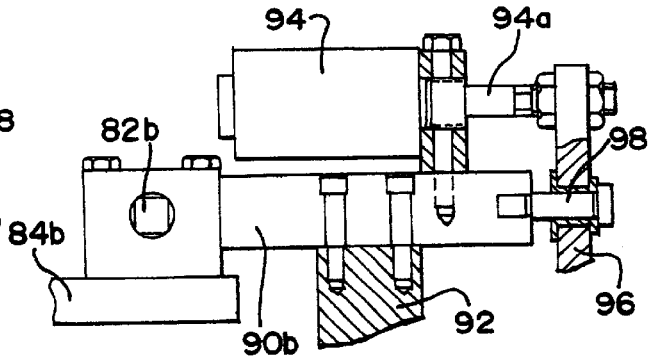
FIG. 9 is an enlarged detailed view of the structure encircled by line 9—9 in FIG. 8.

As the sheets 11 reach the downstream end of the inclined conveyor section 40 defined by roll 46, the sheets pass into a loop conveyor section 54 that is operative to continue movement of the shingled sheets through an upward conveyor path with the sheets continuing in their longitudinal direction established at the discharge end of the inclined conveyor section 40. Referring to FIGS. 4–6, taken in conjunction with FIGS. 1 and 2, the loop conveyor section 54 includes a plurality of parallel flat type conveyor belts 56 that are looped about an upper drive roll 58 and have their lower ends looped about a spring biased series of rolls 60 supported through support arms 60*a* on a common cross-shaft 62. The conveyor belts 56 pass below a series of guide rolls 64 that create an arcuate reach of the conveyor belts after which the belts extend upwardly in a generally vertical plane to the upper roll 58.

The loop conveyor section 54 includes a second set of parallel flat type conveyor belts 70 that are looped about a pair of coplanar upper rolls 72 and 74 and a lower roll 76 so that the belts 70 are in opposed relation to the conveyor belts 56 and contact the conveyor belts 56 through the upwardly curved path established by the guide rolls 64. The conveyor belts 70 and 56 cooperate to define an infeed nip that receives sheets from the inclined conveyor section 40 and transfer the sheets upwardly such that the shingled sheets lie in a vertical plane as they reach the upper end of the conveyor path defined between the belts 56 and 70. The various rolls 58, 64, 72, 74 and 76 are supported in parallel relation between side plates 78*a* and 78*b* of the loop conveyor section 54.

Figure 7:
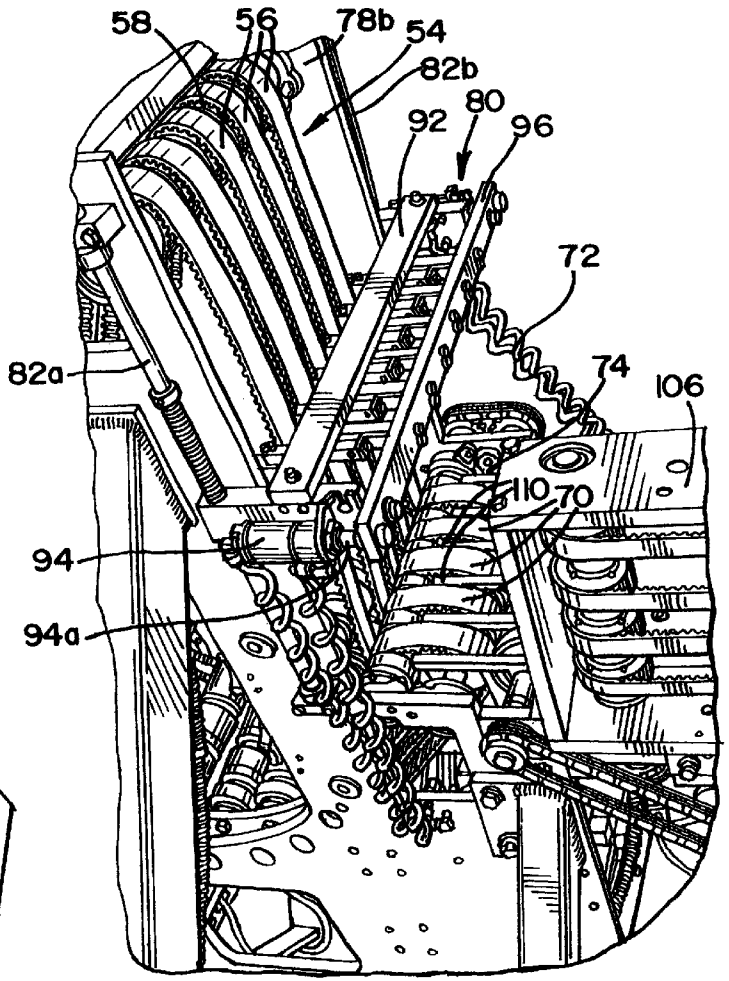
FIG. 7 is a fragmentary perspective view taken from the opposite side of the loop conveyor section shown in FIG. 6 and illustrating the stop mechanism for stopping upward travel of successive sheets as they are conveyed upwardly by the loop conveyor section.
Figure 10:
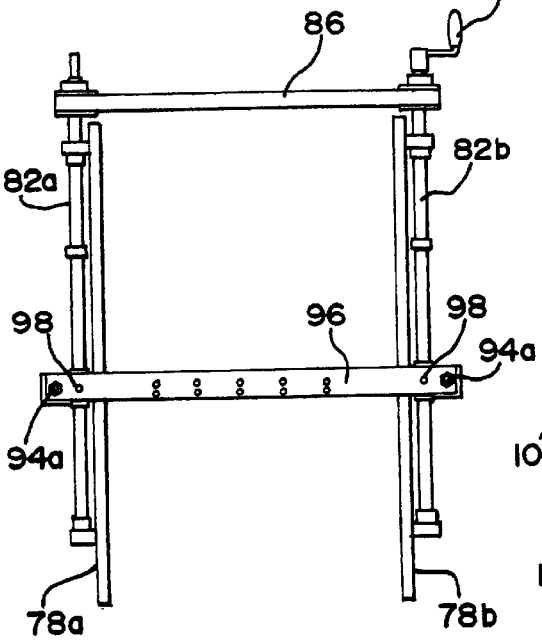
FIG. 10 is a fragmentary elevational view illustrating the interconnected screw shafts for adjusting the height of the sheet stop mechanism.

To limit upward movement of the sheets 11 a predetermined distance after leaving the arcuate path defined by the opposed conveyor belts 56 and 70 within the loop conveyor section 54, a stop mechanism, indicated generally at 80 in FIGS. 6 and 7, is supported by the side plates 78*a, b* of the conveyor section 54 a predetermined distance above the upper end of the loop conveyor path. As illustrated in FIGS. 6 and 7, taken in conjunction with FIGS. 8–11, the stop mechanism 80 includes a pair of parallel screw shafts 82*a* and 82*a* that are mounted on the side plates 78*a, b* of the inclined conveyor section 40. The screw shafts 82*a* and 82*b* are interconnected through a toothed belt or chain arrangement 86 to facilitate corresponding rotation of the screw shafts about their longitudinal axes through a hand crank 88 mounted on the upper end of the screw shaft 82*a*, as illustrated in FIG. 10. A pair of support blocks 90*a* and 90*b* are mounted on the screw shafts 82*a* and 82*b*, respectfully, so that rotation of the screw shafts effects upward or downward movement of the support blocks. The support blocks 90*a* and 90*b* are interconnected through a rectangular crossbar 92 to create a carriage movable upwardly and downwardly along the screw shafts. The support blocks 90*a* and 90*b* each support a double acting pneumatic cylinder 94 having an extendable piston 94*a* connected to an end of an actuating plate 96 so that the longitudinal axes of the pistons 94*a* lie in a plane parallel to the connecting crossbar 92. The actuating plate 96 is also supported on a pair of headed guide pins 98 secured to the outer ends of the support blocks 90*a, b* so that actuation of the operating cylinders 94 effects movement of the actuating plate relative to the support blocks in a horizontal direction.

The actuating plate 96 supports a plurality of parallel spaced coplanar stop arms 100 that extend from the actuating place 96 to positions between the upperly extending reaches of the loop conveyor belts 56. The stop arms 100 define first coplanar stop surfaces 100*a* that are normally positioned in the path of travel of sheets fed upwardly from the cooperating conveyor belts 56 and 70 when the actuating cylinders 94 are actuated to move the actuating plate 96 to its outer position on the guide screws 98. As illustrated in FIGS. 6 and 7, taken in conjunction with FIG. 11A, the stop surfaces l00*a* lie in a plane normal to the longitudinal axes of the upper reaches of conveyor belts 56 and can be positioned above the upper ends of the conveyor belts 70 by actuation of the screw shafts 82*a, b* to a predetermined distance substantially equal to the length of the rectangular sheets 11 considered in their direction of travel. In this manner, the upper transverse edge of each successive shingled sheet conveyed upwardly through the loop conveyor section 54 will engage the stop surfaces 100*a* and force the preceding sheet in a generally horizontal direction into a V-shaped receiving trough 104.

The stop arms 100 define second coplanar stop surface l00*b* that are spaced above and parallel to the coplanar stop surfaces 100*a*. When the actuating cylinders 94 are actuated to draw the actuating plate 96 against the outer ends of the support blocks 90*a, b*, the stop surfaces 100*a* are positioned behind the plane of the upper reaches of the conveyor belts 56. The upper transverse edges of the upwardly traveling sheets thereafter engage the stop surfaces 100*b* and extend above the height of the preceding sheets that engaged the stop surfaces 100*a*.

Figure 11A:
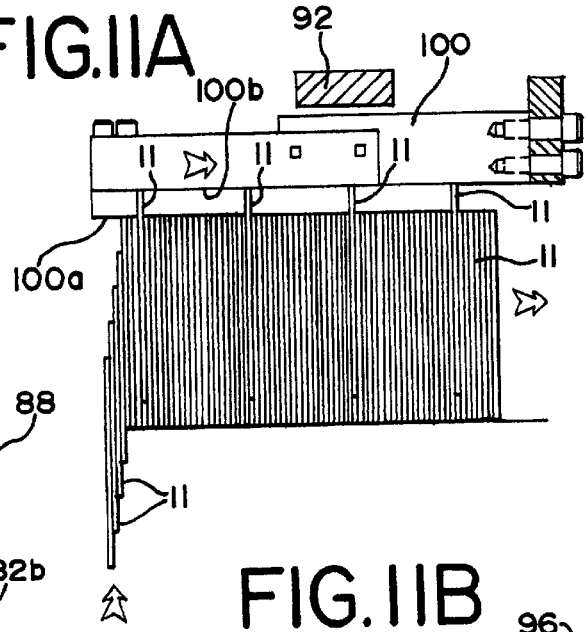
FIGS. 11A and 11B illustrate the stop mechanism in its operating positions to establish physical demarcations between each predetermined batch of horizontally stacked sheets during operation of the conveyor apparatus.
Figure 11B:
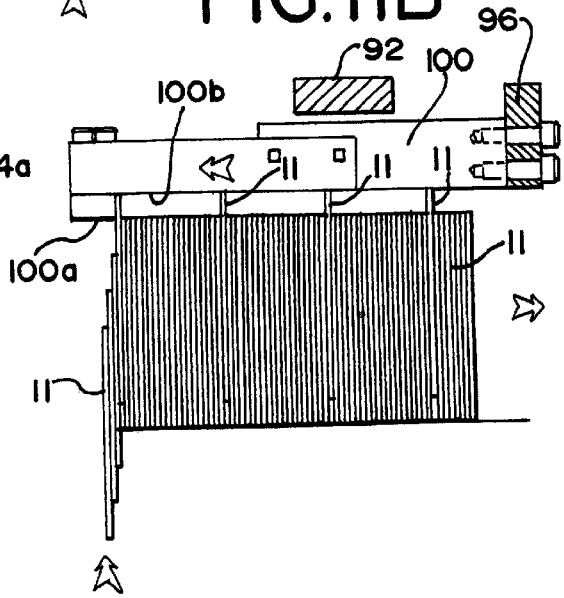

With the stop mechanism 80 as thus described, it will be understood that the actuators 94 may be connected in a control circuit associated with a suitable counter of the sheets conveyed along the conveyor sections 14 and 40, such as an optical counter, so that the leading transverse edges of a predetermined number of upwardly conveyed sheets engage the stop surfaces l00*a* and are moved horizontally to constitute a predetermined sheet batch. After counting a predetermined number of sheets, the actuators 94 immediately move the stop arms 100 to inward positions for a short period of time so that at least one, and preferably several, upwardly traveling sheets immediately following the last sheet in the preceding batch engage the stop surfaces 100*b*. After momentary forward movement of the stop arms 100, the actuators 94 are actuated to return the stop arms 100 to their original outer positions, as shown in FIG. 11A, such that the next following upwardly traveling sheets are again stopped by the stop surfaces 100*a* until a predetermined number of sheets to comprise the next successive batch of sheets has been counted. This sequence of operation creates one or more raised sheets between each predetermined batch of horizontally stacked sheets to thus provide a distinct visual and physical demarcation between successive batches of vertically disposed sheets, as illustrated in FIGS. 11A and 11B. In this manner, an operator can readily visually detect the presence of one or more raises sheets immediately behind each successive predetermined sheet batch and enable the operator to place the fingers of one hand against the downstream exposed raised sheet surface so as to accurately separate the preceding batch of sheets.

As aforedescribed, as successive shingled sheets 11 are conveyed upwardly through the loop conveyor section 54 against the stop mechanism 80, the upstanding sheets are forced in a generally horizontal direction into the V-shaped conveyor trough 104. The trough 104 includes a pair of elongated rectangular frame members 106 and 108 that are supported by the base frame 12 so that planar plate or table surfaces 106*a* and 108*a* on the frame members extend horizontally and form an included right angle therebetween. The trough 104 is supported so that the plate surface 106*a* is inclined to vertical at an angle substantially equal to the angle of incline of inclined conveyor roll 46 relative to horizontal which, is the illustrated embodiment, is approximately 45 degrees.

Figure 12:
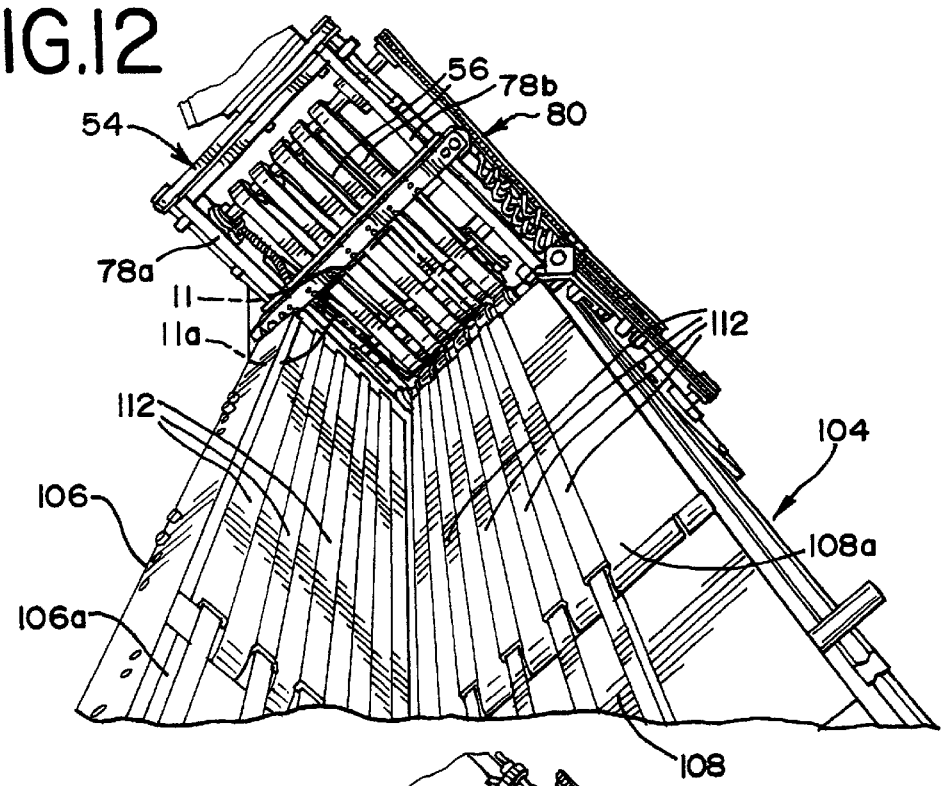
FIG. 12 is an end elevational view illustrating the V-shaped trough and associated conveyor belts for receiving horizontally stacked sheets and from which batches of sheets may be readily removed.
Figure 13:
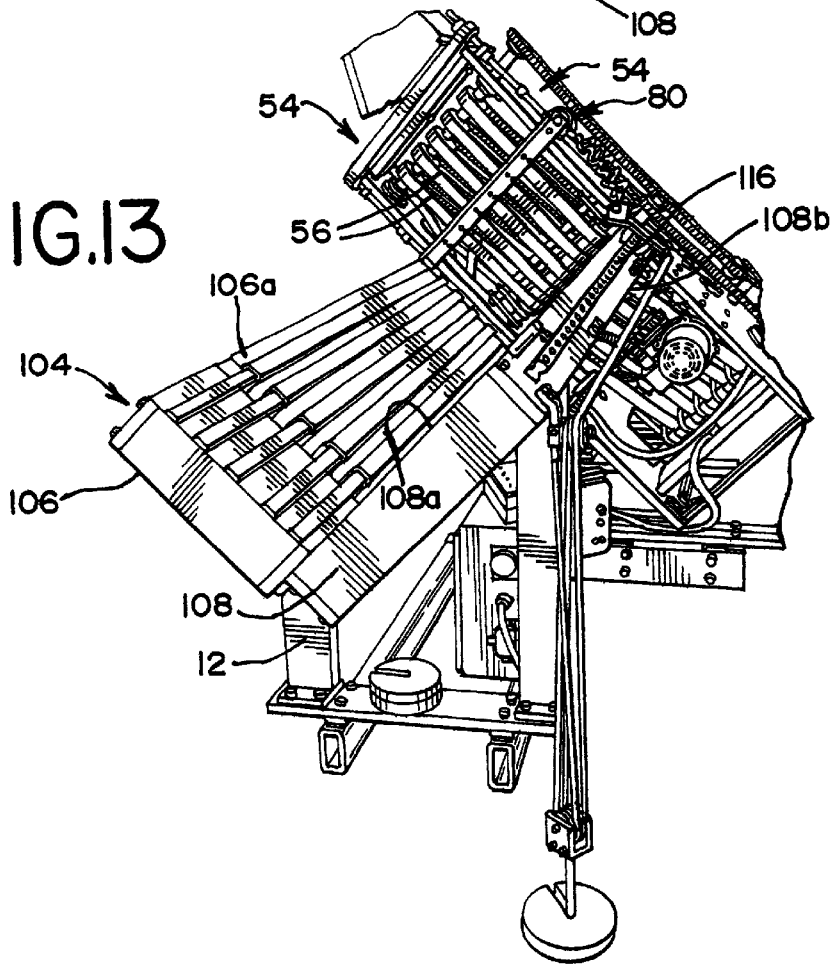
FIG. 13 is a fragmentary perspective view illustrating the weight system for biasing the backstop plates against the sheets being moved into and along the sheet receiving trough but with the backstop plates being removed for purposes of clarity.
Figure 14:
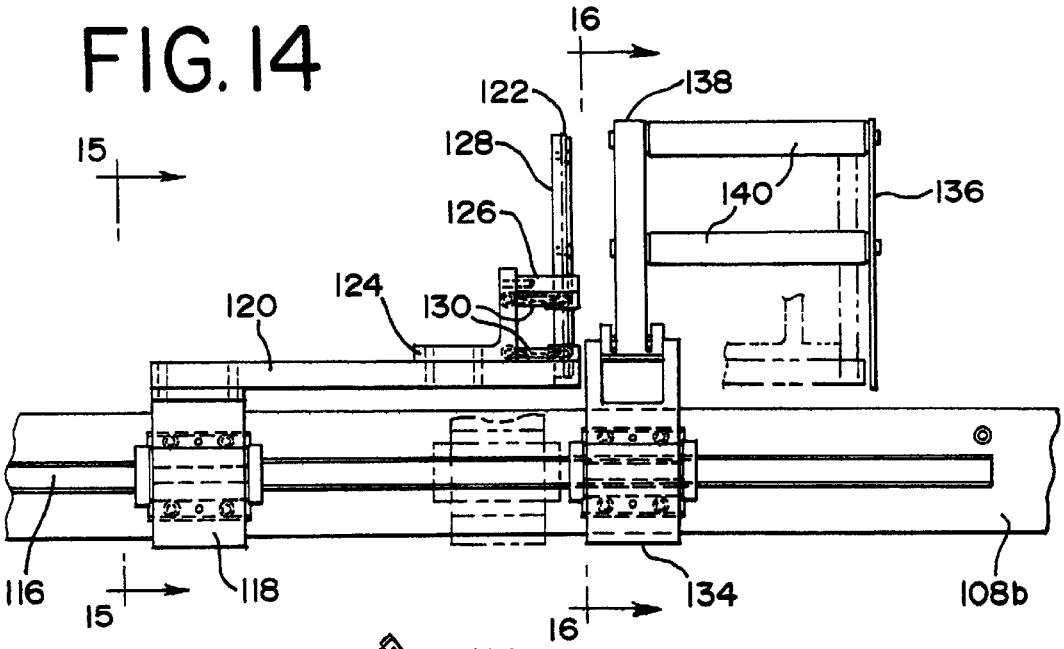
FIG. 14 is a fragmentary side elevational view illustrating the backstop plates in positions in which they are both biased against sheets being fed into the receiving trough.
Figure 15:
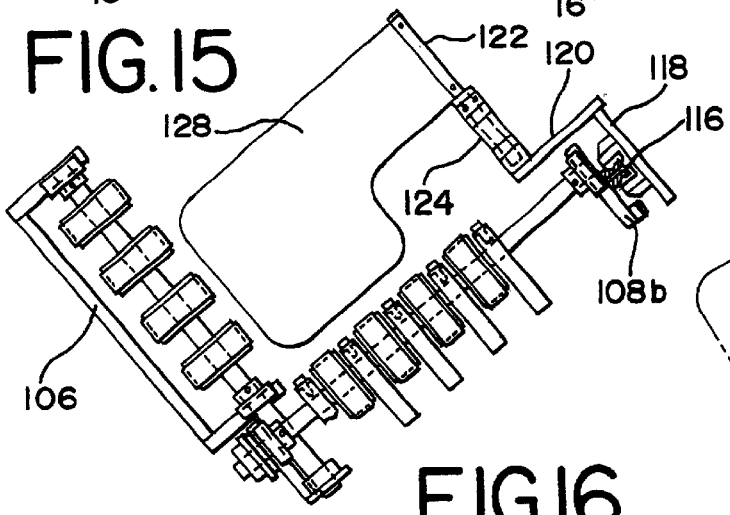
FIG. 15 is a fragmentary sectional view taken substantially along line 15—15 of FIG. 14.
Figure 16:
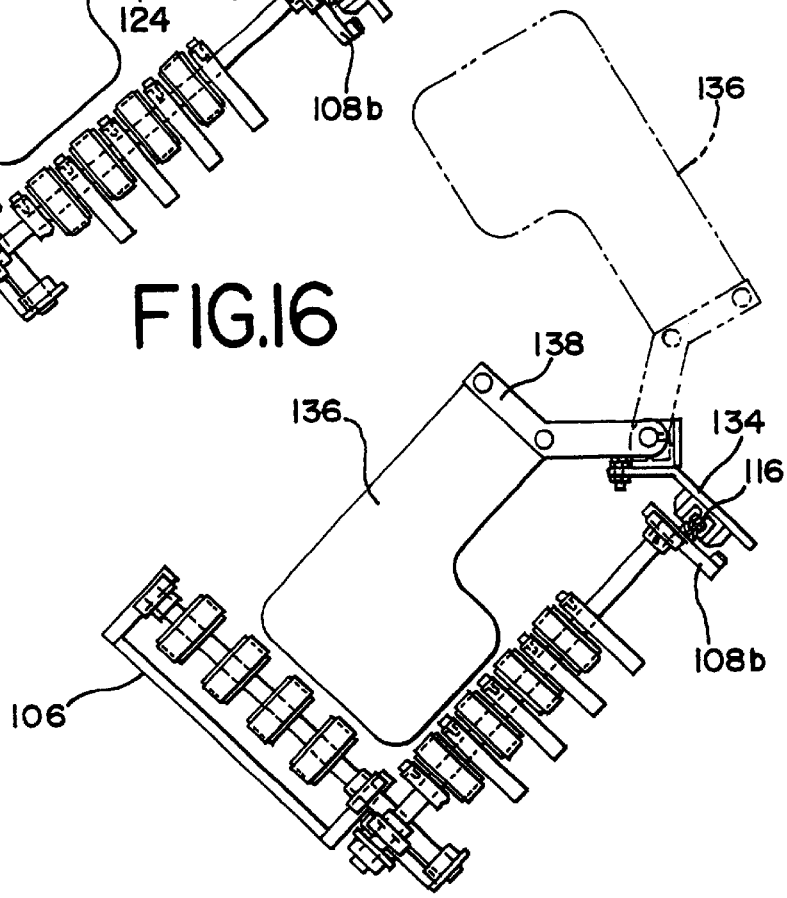
FIG. 16 is a fragmentary sectional view taken substantially along line 16—16 of FIG. 14.

Referring to FIGS. 12 and 13, taken in conjunction with FIGS. 6 and 7, when the sheets 11 engage the stop mechanism 80, the sheets are traveling in a generally vertical plane but in a rectilinear path inclined to vertical at an angle of inclination substantially equal to the angle of inclination of the inclined conveyor roll 46 to horizontal. In this orientation, when the sheets are pushed horizontally by successive sheets fed to the stop mechanism, the lower transverse edge of each successive sheet engages and slides along a plurality of fingers 110 (FIG. 7) that form a bridge to the adjacent end of the plate surface 108*a* of the trough. During this movement, an angularly downward facing lateral edge of each sheet, such as indicated in phantom at 11*a* in FIG. 12, engages a longitudinally extending guide plate that is coplanar with the upper plate surface 106*a* on frame member 106 of the trough.

The trough frame members 106 and 108 each support a plurality of flat endless conveyor belts 112 in parallel spaced relation so that upper reaches of the belts extend along the upper surfaces 106*a*, 108*b* of the V-shaped trough. The conveyor belts 112 are driven at belt surface speeds substantially equal to the belt surface speeds of conveyor belts 56 and 70. In this manner, as the sheets 11 enter the trough 104, the downwardly facing edges of each successive sheet are supported by the upper reaches of the flat conveyor belts 112 and moved along the trough.

In order that the sheets 11 being conveyed along the trough 104 are maintained in an upstanding generally vertical orientation, backstop plate means is provided in cooperation with the trough to engage the downstream facing surface of the first sheet of each predetermined horizontal stack or batch of sheets. Referring to FIGS. 13–16, the trough frame member 108 has an upper edge plate 108*b* on which is mounted an elongated rectilinear guide track 116. A slide plate 118 is slidable along the track 116 and carried a support plate 120 that supports a cylindrical shaft 122 through an L-shaped bracket 124 and a support arm 126. The shaft 122 extends in normal relation to the trough table surface 108*a* and has a generally rectangular backstop plate 128 fixed thereto. The lower end of shaft 122 is rotatable within a bore in plate 120 and is biased by a pair of suitable springs 130 to a position wherein the backstop plate 128 lies in a plane transverse to the conveyor belts 112. The backstop plate 128 may be pivoted about the axis of shaft 122 against the biasing action of springs 130 during manual removal of a batch of sheets disposed with the trough, as will be described.

A second slide plate 134 is slidable along the track 116 between slide plate 118 and the upstream end of trough 104. The slide plate 134 pivotally supports a second generally rectangular backstop plate 136 through a support arm 138 and a pair of parallel cylindrical handgrip bars 140. The backstop plates 128 and 136 and associated support members are configured to enable the backstop plates to be positioned in abutting side-by-side relation, as shown in phantom in FIG. 14, and moved along track 116 so as to engage and support the forward sheet of a horizontal stack of sheets being fed into the trough 104.1. As illustrated in FIG. 13, an elongated suitable strength rope 144 is reeved about a pulley system and supports a suitable weight 146 so that a free end of the rope extends parallel to track 116 and is secured to the slide plate 118 to bias backstop plate toward the incoming sheets from the loop conveyor section.

When sheets 11 are initially conveyed generally horizontally in shingled fashion through the conveyor sections 14, 28 and 40 and upwardly through loop conveyor section 54 to the stop mechanism 80 and then move horizontally into the trough 104, the operator will normally place the palm of a hand against the first sheet to assist in supporting it and the immediately following sheets in upstanding relation. The backstop plates are biased to side-by-side positions at the upstream end of the trough so that they may engage the progressing lead sheet 11 and support it as it is moved along the trough by the progressively advancing horizontal sheet stack.

When a predetermined number of sheets have advanced along the trough against the biasing action of the backstop plates 128 and 136 so that a predetermined batch of sheets is identified by raised height sheets 11 following a predetermined batch of sheets, the operator preferably places his/her left hand fingers against the raised sheets to separate the predetermined batch of sheets from the following sheets. At this point, the operator may grasp the top hand grip bar 140 and pivot the stop plate 136 upwardly and move it to a position where it can be dropped between the hand separated sheets to thereby segregate the predetermined sheet batch from the following sheets. The operator may then swing or pivot the backstop plate 128 outwardly about its pivot shaft axis 122 to enable the operator to grasp both ends of the predetermined batch of sheets and remove it from the trough 104.

Figure 17:
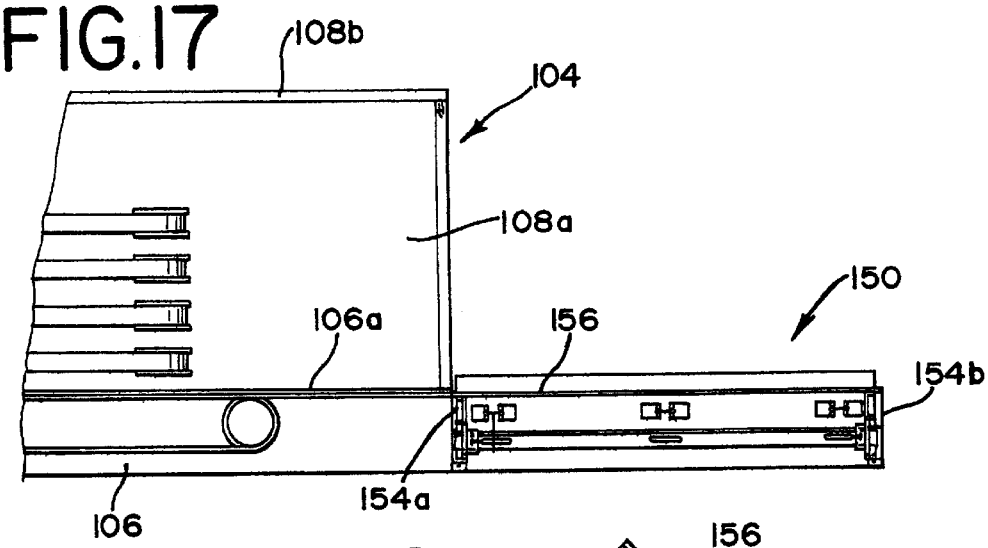
FIG. 17 is a fragmentary view looking downwardly on the trough and illustrating an accessory transfer mechanism secured to the downstream end of the trough.
Figure 18:
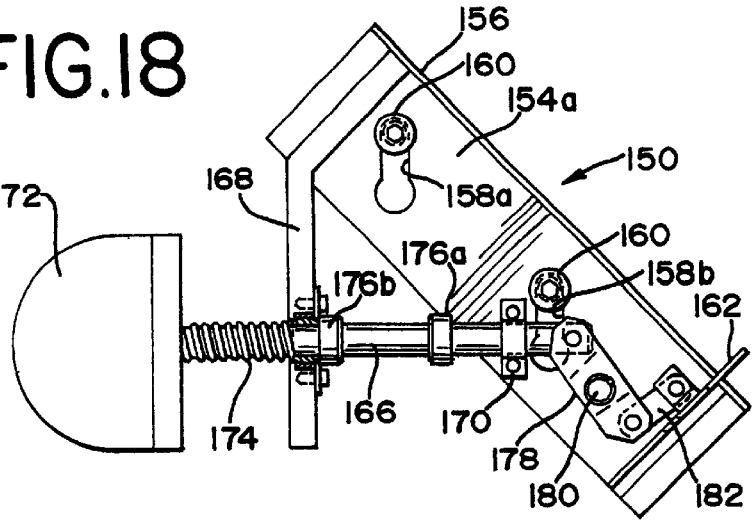
FIG. 18 is an end elevational view, on an enlarged scale, illustrating the mechanism for controlling the position of a sheet support gate of the accessory of FIG. 17.
Figure 19:
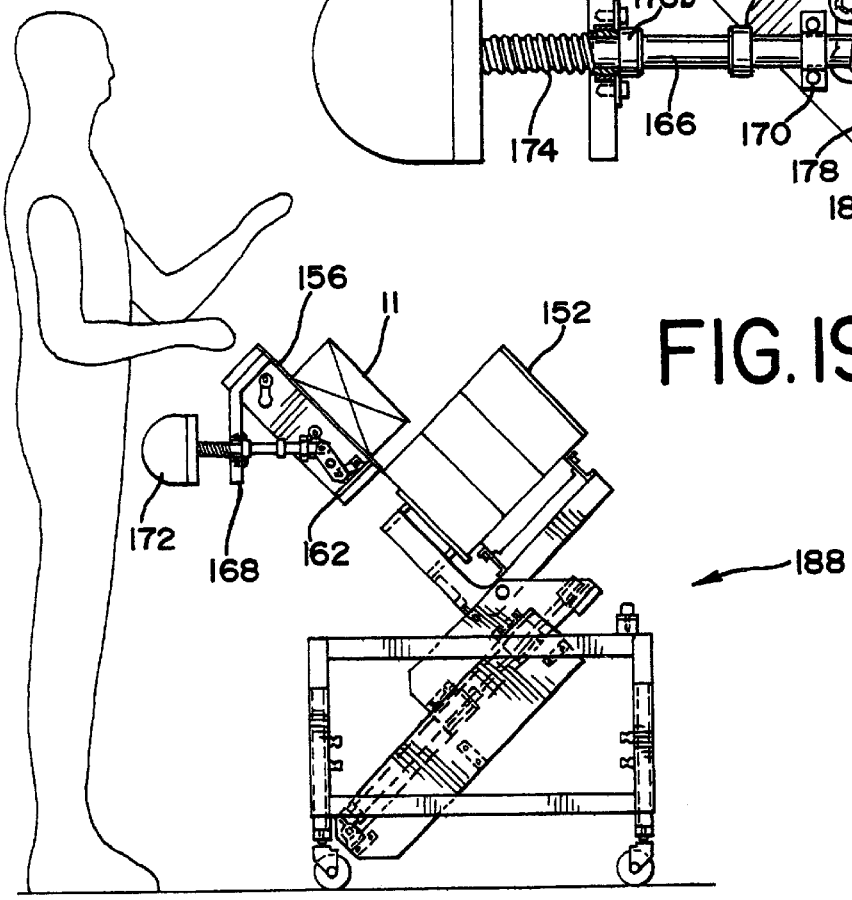
FIG. 19 an end elevational view showing an operator in position to place batches of sheets into a receiving carton.

To facilitate handling of predetermined batches of sheets formed within the trough 104, the present invention provides a number of accessory mechanisms that are cooperative with the trough to enable an operator to insert batches of sheets 11 into a container, such as a box or carton 152, or to support individual batches in a convenient location for placement onto a support pallet or on a banding apparatus for banding the batches of sheets. Referring to FIGS. 17–19, one such accessory mechanism is indicated generally at 150 in FIGS. 17–19 and enables an operator to transfer batches of sheets or signatures from the trough 104 to a position wherein the batches of sheets may be successively placed in a container, such as the rectangular box 152 shown in FIG. 19. The mechanism 150, which may be termed an extension table with a drop gate, includes a generally rectangular frame having a pair of ends plates 154*a* and 154*b* that are fixed in normal relation to a rectangular plate 156. The ends plate 154*a* has a pair of keyhole shaped slots 158*a* and 158*b* formed therethrough to facilitate mounting of the end plate 154*a* against a complimentary end of the trough 104 that has outwardly extending headed screws or stub shafts 160 fixed thereon for releasable connection within the keyhole slots so that the plate 156 is generally coplanar with the upper surface 106*a* of the trough 104.

The transfer mechanism 150 has an elongated rectangular gate plate 162 that extends substantially the length of the rectangular frame of the mechanism and is extendable through the upper plate 156 to a position closely overlying the planar surface 108*a* of trough 104. The gate 162 is movable between a position extending forwardly from the plate 156 and a retracted position rearwardly of the plate 156 by an operator control mechanism that includes a cylindrical actuating shaft 166. Shaft 166 is supported for generally horizontal axial movement adjacent the end wall 154*a* by a support bracket 168 and bushing 170. The shaft 166 has a cushion 172 fixed on its outer end and is biased to a position extending the gate 162 by a coil compression spring 174 disposed between the bracket 168 and the cushion 172. Axial movement of the shaft 166 is limited by a pair of bushings 176*a* and 176*b* that act against the plate 168 and bushing 170, respectively. The end of shaft 166 opposite the cushion 172 is connected through a lost motion connection to a rocker arm 178 fixed on a pivot pin 180 secured in normal relation to the end wall 154*a*. The opposite end of the rocker arm 178 is pivotally connected to a link 182 that in turn is pivotally connected to the gate 162. In this manner, an operator, such as shown in FIG. 19, can engage the cushion 172 and actuate the gate 162 between extended and retracted positions while the operators hands remain free to grasp a batch of sheets 11 from the conveyor trough 104 and place them on the extended gate 162 against the plate 156, as illustrated in FIG. 19.

Figure 20:
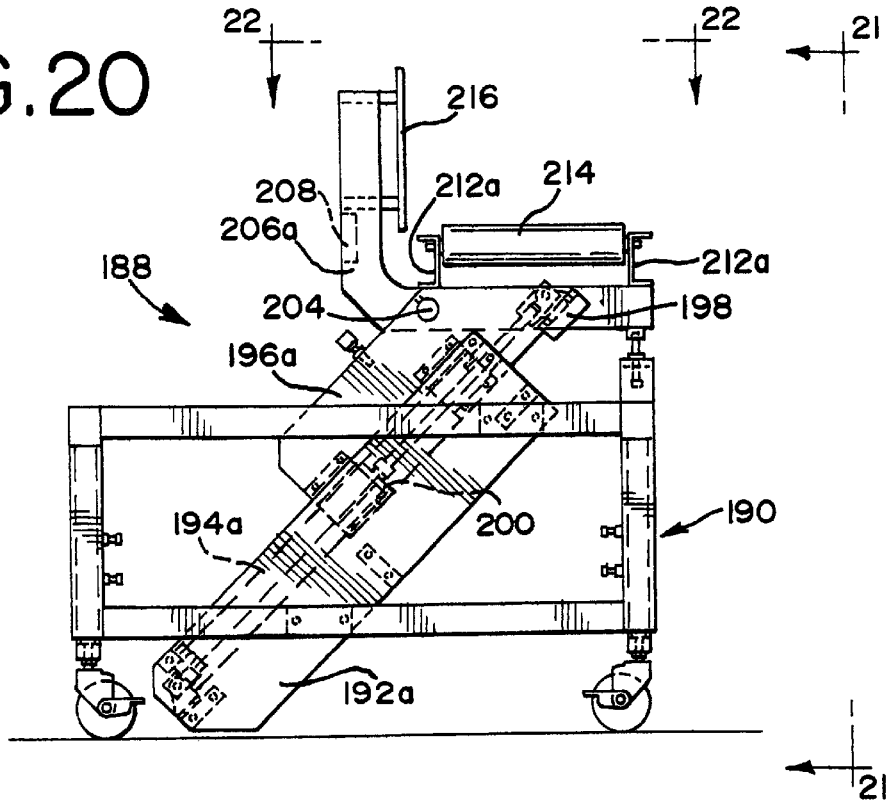
FIG. 20 is a side elevational view of the carton support carriage of FIG. 19.
Figure 21:
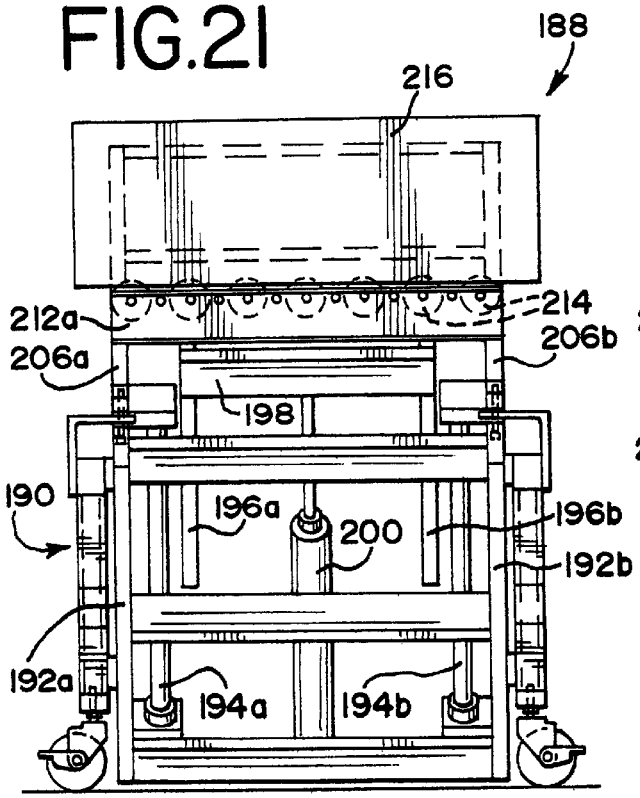
FIG. 21 is a front elevational view taken substantially along line 21—21 of FIG. 20.
Figure 22:
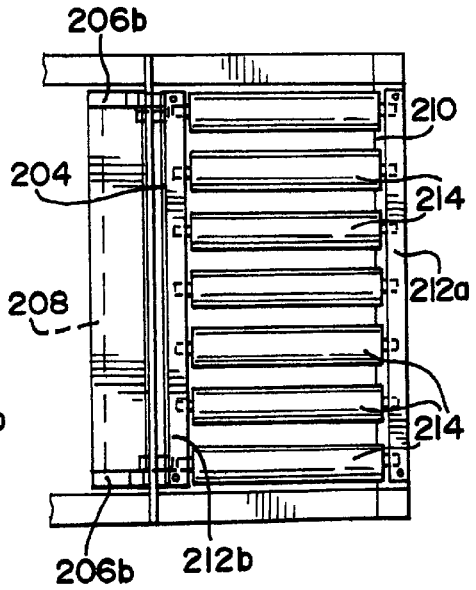
FIG. 22 is a fragmentary plan view taken substantially along line 22—22 of FIG. 20.

When it is desired to place a plurality of batches of sheets 11 from the trough 104 into a container, such as the rectangular box 152, the box is placed on an indexing support mechanism, indicated generally at 188, that, in the illustrated embodiment, can be indexed or positioned to receive three batches of sheets 11. Referring to FIGS. 20–22, taken in conjunction with FIG. 19, the box support mechanism 188 includes a generally rectangular wheeled open frame carriage 190 to the lateral sides of which are affixed a pair of parallel rectangular support plates 192*a* and 192*b*. The support plates 192*a* and 192*b* each support a cylindrical guide shaft 194*a* and 194*b*, respectively, on which are mounted slide blocks that support parallel support plates 196*a* and 196*b*, respectively, for movement in an upwardly inclined direction parallel to the guide shafts 194*a, b*. The support plates 196*a , b* are connected by a cross plate 198 to which is pivotally connected the piston end of a pneumatic or hydraulic cylinder 200 that enables selective movement of the support plates 196*a, b* upwardly or downwardly on the guide shafts 194*a, b*.

The support plates 196*a, b* support a horizontal pivot shaft 204 on which is mounted a pair of laterally spaced generally L-shaped arms 206*a* and 206*b*. The arms 206*a, b* are interconnected by a pair of parallel cross plates 208*a* and 210. A pair of generally C-shaped channels 212*a* and 212*b* are fixed to and transversely of the support arms 206*a, b* and support a plurality of coplanar rollers 214 as illustrated in FIG. 22. The upwardly extending portions of the L-shaped arms 206*a, b* support a planar plate 216 that lies in a plane normal to the plane of the upper surface of the rollers 214. In this manner, a rectangular box, such as in shown at 152 in FIG. 19, can be placed on the rollers 214 with one side of the container abutting the plate 216.

In loading a plurality of batches of sheets 11 into the carton or box 152, a batch of sheets from the horizontal stack on the trough 104 is grasped by the operator and placed in edge relation on the surface 156 of the transfer accessory 150 which is oriented at an angle such that the weight of the stack sheets maintains them on the gate. Having placed a container box 152 on the rollers 214 of the support mechanism 188, the arms 206*a, b* are rotated about their pivot axis 204 so that the container assumes an orientation as illustrated in FIG. 19 with an end of the carton being generally coplanar with the surface 156. While grasping the ends of the stack of sheets 11 in a guiding fashion, the operator may move his body forward to engage the cushion 172 so as to retract the gate plate 162 thereby releasing the stack of sheets for entry into the carton. At this point, the actuating cylinder 200, which is preferably connected in a control circuit enabled by the operator or in a weight sensitive control circuit, allows the distance of the actuating cylinder to be retracted sufficiently to lower the carton in a direction parallel to the guide shafts 194*a, b* to place the top sheet of the previously introduced stack of sheets in generally coplanar relation with the surface 156. Thereafter, by placing a second stack of sheets on the gate 162 which has been released so that the spring 174 returns the gate to its extended position, and the second stack of sheets guided into the carton 152 in similar fashion to insertion of the first stack. Thereafter, the carton support mechanism 188 is again indexed, either under the control of the operator or in response to sensing of two stacks of sheets within the carton 152, so as to align the remaining area of the carton in a position to receive a third stack of sheets 11. Following loading of the carton 152 the piston 200 is again actuated to extend the support plates 196*a, b* to their upper position whereupon the brackets 206*a, b* are rotated about their pivot axis 204 to a position wherein the rollers 214 lie in a generally horizontal plane enabling the loaded carton 152 to be readily moved in a horizontal direction onto another conveyance apparatus or onto a pallet for transfer.

Figure 23:
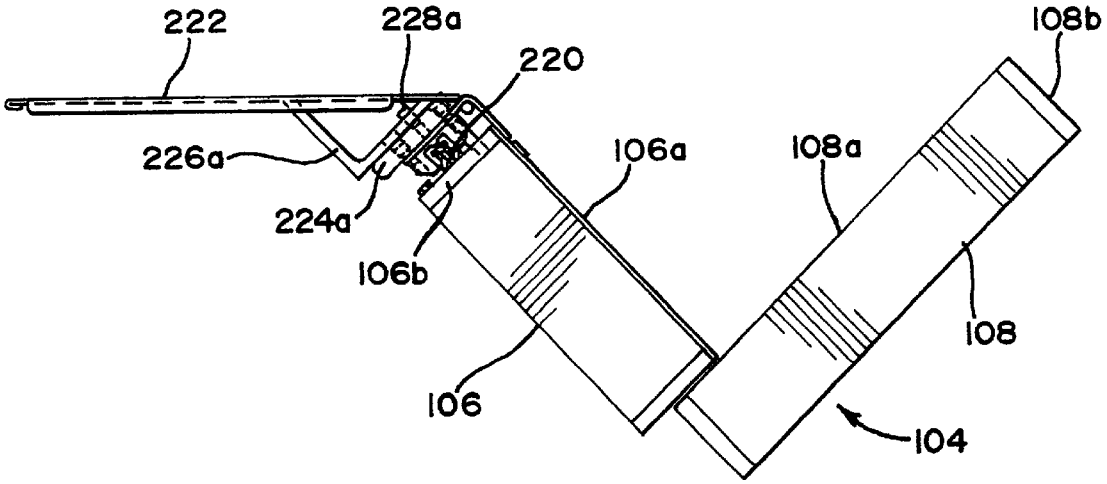
FIG. 23 is a fragmentary end elevational view of the trough having an accessory support plate mounted thereon.
Figure 24:
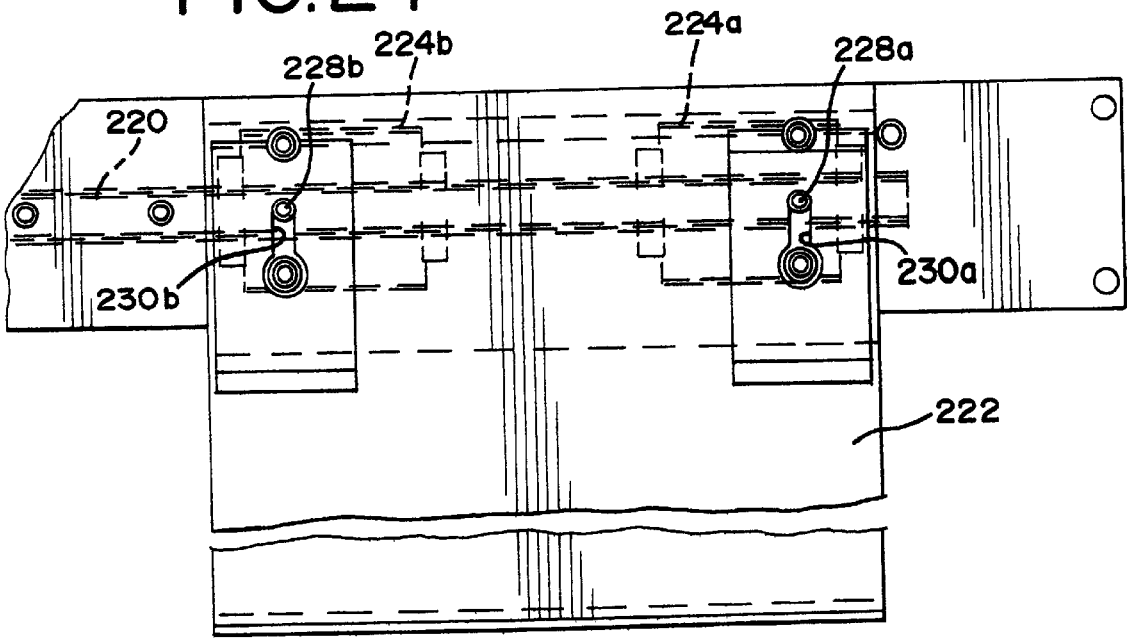
FIG. 24 is a fragmentary plan view of the support plate and guide track of FIG. 23.

Referring to FIGS. 23 and 24, the trough 104 may also have an elongated track 220 mounted on and along a longitudinal frame member 106*b* of the trough frame member 106. A rectangular support plate 222 is mounted on a pair of guide plates or carriages 224*a* and 224*b* through a pair of angles 226*a* and 226*b*, respectively. The angles 226*a, b* are releasably mounted on the guide plates 224*a, b* through a pair of headed screws 228*a* and 228*b* that are received, respectively, that are releasably received, respectively, within keyhole shaped slots 230*a* and 230*b* formed in the portions of the angles 226*a, b* that engage the guide plates.

The support plate 223 being thus supported adjacent the trough 104 and being movable along the length of the trough, enables an operator to position the support plate 222 at a desired location along the length of the trough and move a predetermined batch of sheets from the trough onto the support plate 222. The operator may then move the plate and supported sheets to a position from which they may be moved onto a pallet or to a banding apparatus operative to place retaining bands about the batch of sheets.

Having thus described a conveyor apparatus for horizontal stacking of sheets in vertical orientations on a trough so that downwardly facing edges of the sheets are supported within the trough, batches of sheets of predetermined number can be accurately identified by an operator as the sheets move along the length of the trough with the leading sheet engaged by the backstop plate 136 against which the backstop plate 128 is biased. The operator can readily identify a predetermined batch of sheets by visually observing the raised height sheet immediately following the predetermined number of sheets. The raised sheet also enables the operator to place the fingers of one hand against the raised sheet and move his/her hand downwardly to separate the preceding sheets followed by raising the backstop plate 136 and moving it to a position where it can be dropped into the separation created between the last sheet of the predetermined number of sheets and the next succeeding sheet. Thereafter, the operator can manually separate the batch of sheets and after rotating the backstop plate 126 toward the downstream end of the trough, manually remove the batch of sheets for placement on the drop gate plate 162 to facilitate placement of the stack within a carton 152 having been previously placed in proper position to receive the stack. Alternatively, the operator can place the batch of sheets on the support plate 222 for movement to the downstream end of the trough preparatory to transfer onto a pallet or other supporting means or to a banding apparatus.

While a preferred embodiment of the present invention has been illustrated and described, it will be understood to those skilled in the art that changes and modifications may be made therein without departing the from the invention in its broader aspects. Various features of the invention are defined in the following claims.

We claim:

1. A method for stacking generally rectangular sheets in a substantially horizontal stack of generally vertically disposed sheets, said method comprising the steps of:

conveying said sheets in consecutive shingled order along a generally horizontal conveyor path, causing said sheets to successively pass from said generally horizontal conveyor path to a downstream conveyor path along which said sheets are progressively rotated to positions inclined relative to horizontal as the sheets reach a downstream end of said downstream conveyor path, causing said sheets to successively pass from said downstream conveyor path to a conveyor path operative to continue travel of said sheets in an upwardly directed path coincident with their direction of travel at the downstream end of the downstream conveyor path, stopping a first predetermined number of consecutive sheets in succession at a first predetermined position during travel along said upwardly directed path and causing said first predetermined number of consecutive sheets to be progressively moved generally horizontally after being stopped at said first predetermined position, causing at least one sheet traveling immediately behind said first predetermined number of sheets to be stopped at a second predetermined position so that an upper edge of said at least one sheet behind said predetermined number of sheets extends above the upper edges of at least the last of said first predetermined number of sheets, and causing said at least one sheet to be moved generally horizontally immediately behind said first predetermined number of sheets so as to create a physical demarcation between the last of said first predetermined number of sheets and said at least one sheet to thereby enable an operator to readily manually grasp said predetermined number of sheets for separation and removal from said sheets immediately behind said first predetermined number of sheets.

2. The method as defined in claim 1 wherein said generally horizontal conveyor path is defined by a first conveyor, and including the steps of conveying said sheets along a second generally horizontal conveyor path disposed upstream from said first conveyor path and at an angle to said second conveyor path so as to expose at least one corner of each successive sheet passing to said first conveyor path, and counting said plurality of sheets by means of an optical counter adapted to detect said exposed corners of said sheets, said optical counter being operative to create a control signal after counting a predetermined number of sheets, said step of causing said at least one sheet traveling immediately behind said first predetermined number of sheets to be stopped at said second position being responsive to said control signal.

3. The method as defined in claim 1 wherein said downstream conveyor path is defined by a plurality of parallel conveyor belts that establish an upper reach having a substantially horizontal upstream end and an inclined downstream end so that sheets conveyed along said upper reach are progressively rotated from horizontal to inclined positions.

4. The method as defined in claim 3 wherein the angle of incline of said downstream end of said upper reach of conveyor belts is sufficient to cause said sheets to slide downwardly toward a lower edge of said upper reach of conveyor belts as the sheets are conveyed from said upstream end to said downstream end.

5. The method as defined in claim 4 including the step of oscillating said upper reach of conveyor belts to assist in said downward sliding of said sheets.

6. The method as defined in claim 4 including the step of providing an edge guide along substantially the length of said upper reach of conveyor belts so that sheets carried along and sliding downward on said upper reach engage said edge guide to align the lateral longitudinal edges of said sheets.

7. The method as defined in claim 1 wherein said step of moving said sheets generally horizontally after stopping said sheets at said first predetermined position comprises moving said sheets into a generally V-shaped receiving trough operative to engage and support two downwardly directed edges of each sheet.

8. The method of claim 7 wherein said V-shaped trough has a pair of upwardly exposed surfaces and at least one conveyor belt provided lengthwise of each upwardly exposed surface, said conveyor belts being operative to move sheets received in said trough in a downstream direction.

9. The method as defined in claim 1 wherein step of rotating said sheets to inclined positions comprises rotating said sheets to angles of incline between approximately 15° and 70° relative to horizontal.

10. A horizontal sheet stacking and batching system comprising, in combination, a first conveyor section operative to receive sheets or signatures from a web press and convey said sheets along a generally horizontal path while disposed in a generally flat orientation, a second conveyor section downstream from said first conveyor section for receiving sheets from said first conveyor section, said second conveyor section including means for rotating said sheets about their direction of travel from a substantially flat orientation to positions inclined to horizontal as said sheets travel from an upstream end to a downstream end of said second conveyor, a loop conveyor section operative to receive sheets from said second conveyor section and convey said sheets in an upward direction disposed in a generally vertical orientation as they leave the downstream end of said second conveyor, a stop mechanism operative to stop upward movement of said sheets on said loop conveyor section at a predetermined position so that successive sheets cause preceding sheets to move generally horizontally while generally vertically disposed, and a receiving trough having a generally V-shaped transverse cross-sectional configuration, said sheets being oriented during said upward movement so that each sheet has two downwardly facing edges that are received in and supported by said V-shaped trough as said sheets undergo said horizontal movement while vertically disposed.

11. A sheet stacking and batching system as defined in claim 10 including a backstop plate cooperative with said trough so as to be movable generally along the length of said trough while said plate is disposed in a plane transverse to said trough, and biasing means associated with said plate to bias said backstop plate toward sheets being fed into said trough.

12. A sheet stacking and batching system as defined in claim 11 wherein said backstop plate is adapted to be pivoted by an operator to a position generally clear of said sheets to enable an operator to manually engage the sheet previously abutting said backstop plate.

13. A sheet stacking and batching system as defined in claim 11 wherein said trough includes at least one conveyor belt operatively associated with each of a pair of upwardly facing surfaces of said V-shaped trough, each of said conveyor belts being operative to engage and assist in movement of sheets along said trough.

14. A sheet stacking and batching system as defined in claim 10 wherein said stop mechanism is operative in a first position to be engaged by a predetermined number of successive sheets moving in said upward path so that upper edges of said predetermined number of sheets are at substantially the same elevation as they move into said trough, said stop mechanism being movable to a second position enabling one or more sheets immediately following said predetermined number of sheets to travel upwardly a distance greater than the distance traveled by said predetermined number of sheets when said stop mechanism is in its said first position so that a physical demarcation is created between the last sheet to engage said stop mechanism when in its first position and the next successive sheet stopped by said stop mechanism when in said second position.

15. A horizontal sheet stacking and batching system as defined in claim 11 including a second backstop plate cooperative with said trough and movable along the length of said trough, said second backstop plate being adapted to be interposed between said first backstop plate and the sheets being fed into said trough, and being movable by an operator to a position spaced from said first backstop plate toward said incoming sheets to enable the operator to place said second backstop plate behind a predetermined batch of sheets disposed within said trough while allowing incoming sheets to move progressively along the length of said trough.

16. A method for stacking generally rectangular sheets in a substantially horizontal stack of generally vertically disposed sheets, said method comprising the steps of:

conveying said sheets in consecutive order along a generally horizontal conveyor path, causing said sheets to successively pass from said generally horizontal conveyor path to a downstream conveyor path along which said sheets are progressively rotated to positions inclined relative to horizontal as the sheets reach a downstream end of said downstream conveyor path, causing said sheets to successively pass from said downstream conveyor path to a conveyor path operative to continue travel of said sheets in an upwardly directed path, stopping a first predetermined number of consecutive sheets in succession at a first predetermined position during travel along said upwardly directed path and causing said first predetermined number of consecutive sheets to be progressively moved generally horizontally after being stopped at said first predetermined position, causing at least one sheet traveling immediately behind said first predetermined number of sheets to be stopped at a second predetermined position so that an upper edge of said at least one sheet behind said predetermined number of sheets extends above at least the last of said first predetermined number of sheets, and causing said at least one sheet to be moved immediately behind said first predetermined number of sheets so as to create a physical demarcation between the last of said first predetermined number of sheets and said at least one sheet to thereby facilitate separation of said predetermined number of sheets from said sheets immediately behind said first predetermined number of sheets.

17. The method of claim 16 wherein said upwardly directed path is coincident with the direction of travel at the downstream end of said downstream conveyor path.

18. The method as defined in claim 17 wherein said generally horizontal conveyor path is defined by a first conveyor, and including the steps of conveying said sheets along a second generally horizontal conveyor path disposed upstream from said first conveyor path and at an angle to said second conveyor path so as to expose at least one corner of each successive sheet passing to said first conveyor path, and counting said plurality of sheets by means of an optical counter adapted to detect said exposed corners of said sheets, said optical counter being operative to create a control signal after counting a predetermined number of sheets, said step of causing said at least one sheet traveling immediately behind said first predetermined number of sheets to be stopped at said second position being responsive to said control signal.

19. The method as defined in claim 17 wherein said downstream conveyor path is defined by a plurality of parallel conveyor belts that establish an upper reach having a substantially horizontal upstream end and an inclined downstream end so that sheets conveyed along said upper reach are progressively rotated from horizontal to inclined positions.

20. The method as defined in claim 19 wherein the angle of incline of said downstream end of said upper reach of conveyor belts is sufficient to cause said sheets to slide downwardly toward a lower edge of said upper reach of conveyor belts as the sheets are conveyed from said upstream end to said downstream end.

* * * * *